United States Patent [19]

Jones et al.

[11] 4,105,210

[45] Aug. 8, 1978

[54] HOCKEY GAME APPARATUS

[75] Inventors: Lawrence T. Jones, Manhattan Beach, Calif.; William Jacobs, Edwardsville, Ill.

[73] Assignee: California R & D Center, Culver City, Calif.

[21] Appl. No.: 647,923

[22] Filed: Jan. 9, 1976

[51] Int. Cl.[2] ..... A63F 3/00

[52] U.S. Cl. ..... 273/126 R; 273/1 B

[58] Field of Search ..... 273/1, 119, 126, 134, 273/85

[56] References Cited

U.S. PATENT DOCUMENTS

| | | | |
|---|---|---|---|
| 1,550,039 | 8/1925 | Mytton | 273/126 R X |
| 2,985,451 | 5/1961 | Sims | 273/1 R |
| 3,184,237 | 5/1965 | Riva | 273/134 G |
| 3,202,427 | 8/1965 | Patent | 273/126 R |
| 3,913,918 | 10/1975 | Trachtman | 273/126 R |

*Primary Examiner*—Delbert B. Lowe

*Attorney, Agent, or Firm*—Harold L. Jackson; Stanley R. Jones; Joseph W. Price

[57] ABSTRACT

The present invention is an action game apparatus for two or more players and includes a disc, or puck, capable of simulating a mouse and a shell housing enclosing a playing surface and having a plurality of apertures creating an appearance of a Swiss cheese cake. An L-shaped stick is utilized by the respective players for insertion through the apertures to strike the game disc. A plurality of goal openings are mounted about the periphery of the shell housing and a player scores when a disc is propelled through a goal. A scoring device including a peg and a plurality of holes can also be mounted adjacent the shell housing.

13 Claims, 3 Drawing Figures

HOCKEY GAME APPARATUS

BACKGROUND OF THE INVENTION

1. Field of the Invention

The present invention is directed generally to an action game apparatus for two or more players, and more particularly to a game board having a shell housing with a plurality of apertures for receiving a striking member for propelling a game projectile through appropriate goal openings.

2. Description of the Prior Art

Various forms of games, both in commercial enterprises and for individual home use, have been suggested in the prior art. For example, various forms of simulated hockey and soccer games have been suggested to provide a play action game for two or more players, such as U.S. Pat. No. 3,913,918. Usually, these games have utilized a simulated player who is controlled by levers, or rods, to rotate or spin in hitting and propelling a ball. These games are usually relatively expensive and generally appeal to adults, or older children. There is a need in the prior art to provide action games that are relatively inexpensive and are suitable for play by young children, as well as older children and adults.

SUMMARY OF THE INVENTION

The present invention provides an action game apparatus wherein the playing board simulates the appearance of a cake of Swiss cheese and a game projectile, which can be appropriately marked, simulates a mouse. Each player is provided with a striking member for propelling the game projectile. A shell housing encloses the playing surface and has a first plurality of apertures for permitting access of the propelling members to move the projectile across the playing surface and, thereby, coact with a plurality of goal positions on the housing to indicate the score by a player. The propelling members are generally longer in width than the height of the housing and the apertures are positioned both on the sides and top of the shell housing. The goal positions are preferably a series of semi-circle openings about the periphery of the shell housing.

Scoring means are provided for permitting an individual tally of the scores of each player. The scoring means can include a plurality of aligned holes adjacent a goal aperture with a peg adapted to be appropriately positioned relative to a hole, and if necessary, appropriate indicia adjacent the hole to indicate an individual player's score. Since in the preferred embodiment the goal apertures number approximately four, an appropriate hole is positioned adjacent the periphery of the shell housing and, preferably, aligned within the goal aperture to receive the individual scoring peg and, thereby, render the goal aperture inoperative for passing the game projectile. Accordingly, if only two players are playing the game, the other goal apertures can be rendered respectively inoperative by pegs. Also, if a player has been eliminated from the game by the reason of any desired scoring system, the individual player's goal aperture can likewise be rendered inoperative.

BRIEF DESCRIPTION OF THE PREFERRED EMBODIMENT

The following description is provided to enable any person skilled in a toy-making art to make and use the invention and sets forth the best mode contemplated by the inventor of carrying out his invention. Various modifications, however, will remain readily apparent to those skilled in the art, since the generic principles of the present invention have been defined herein specifically to provide an action game apparatus that can be manufactured in a relatively economical manner.

Figure 1:
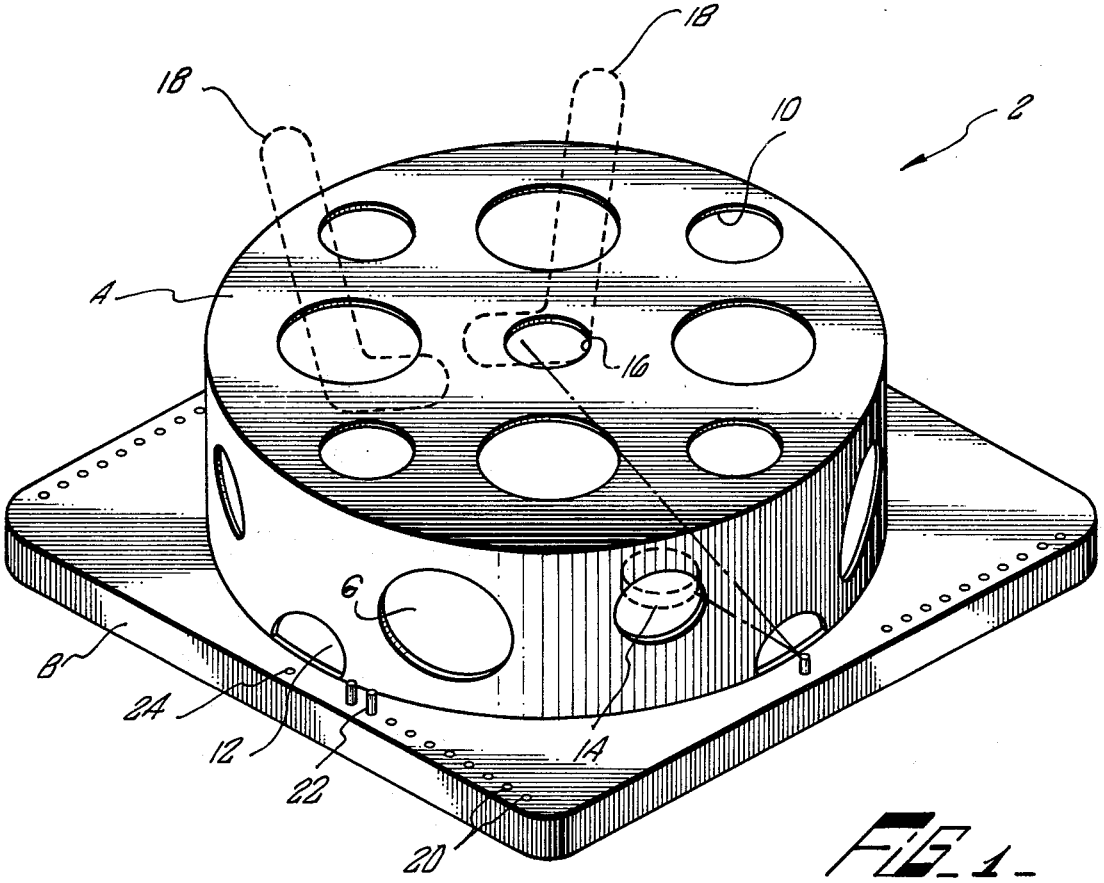
Referring to FIG. 1, a perspective view of the shell housing of the present invention is disclosed.
Figure 2:
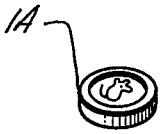
Referring to FIG. 2, a perspective view of the game projectile of the present invention is disclosed; and Referring to FIG. 3, a plan view of the propelling member of the present invention is disclosed.

Referring to FIG. 1, the game apparatus 2 includes a shell housing 4 which encloses a playing surface 6. Generally, a base 8 will be provided which has a rectangular shape and provides the planar playing surface 6. Both the shell housing and base 8 are preferably made from plastic, although other materials may be utilized.

In the preferred embodiment, the shell housing 4 is shaped to give the appearance of a cake of Swiss cheese, and preferably, has a cream, or yellow, color. The cylindrical shell housing 4 has a first plurality of apertures, or holes 10 on both the side and top of the shell housing 4. Additionally, a plurality of goal positions, or goal apertures, 12 are disposed about the periphery of the shell housing 4 in an appropriately spaced manner. For example, in the preferred embodiment, four goal apertures 12 are mounted at 90° positions about the periphery of the shell housing 4.

Figure 3:
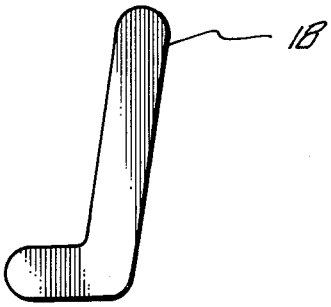

A game projectile 14, preferably, has a disc, or puck-like shape, with a recessed surface for carrying an appropriate indicia, such as a picture of a mouse. Other shapes can be utilized within the invention. The projectile 14 can be formed of plastic, hard rubber, wood, etc. The game projectile 14 can be introduced through a central aperture 16 on top of the shell housing 4. A plurality of L-shaped propelling members 18, or striking sticks, of which one embodiment is disclosed in FIG. 3, are designed to be utilized by the individual players. The relative size of the apertures 10 is such as to permit an easy access of the propelling members for striking and propelling the game projectile 14 across the playing surface 6. The propelling members 18 may be operatively inserted through any aperture on the shell housing 4, to strike the projectile 14. Generally, the first aperture holes 10 can be dimensioned to permit ready egress of the propelling member 18, but not introduction of the player's hand into the shell housing 4.

Scoring means including a plurality of aligned holes 20 and a scoring peg 22 are provided adjacent the goal apertures 12. The individual players, by moving the scoring peg 22, can record the individual scores. Appropriate indicia can be printed on the base member 8 adjacent each hole 20. Additional holes 24 positioned in the goal apertures are designed to also receive the scoring pegs 22 for rendering the appropriate goal aperture 12 inoperative for passing a game projectile 14.

In operation, the individual players select an appropriate side, or goal aperture 12. If only two players are playing, the scoring pegs of the inactive goal apertures 12 can be inserted into the appropriate holes 24 to render those goal apertures inoperative. The player selects an appropriate propelling member 18, which can have the form of a hockey stick, and has a length greater than the height of the shell housing 4. The propelling member 18 is designed to extend only a relatively short distance, for example, an inch, above the shell housing to limit the leverage that can be exerted by the player against the game projectile 14. The game projectile 14 is then dropped through the central aperture 16 and the respective players attempt to utilize their propelling members 18 to strike the game projectile 14 and propel it through an opponent's goal aperture 12. An individual score tally is kept for each player on the score means by the appropriate position of a peg 22 in the scoring holes 20. The first player to move his scoring peg 22 to the final hole 20 wins the game. The provision of a shell housing 4 having the appearance of a cake of Swiss cheese, is especially pleasing to younger children, while at the same time, requiring dexterity and skill in manipulating the propelling members 18 through the apertures 10 in the shell housing 4. The game projectile 14 is appropriately arranged to carry indicia on its surface, or in the alternative, to assume a mouse-like shape which complements the shell housing 4. If desired, the propelling members 18 can take other forms, such as a cat's paw, to further complement the design structural features of the present invention.

The unique method of game play can be seen from FIG. 1 wherein a pair of sticks, or propelling members 18 are shown inserted into the shell housing 4. Each propelling member 18 is controlled by a player and can be selectively inserted into any of the apertures 10. The game projectile 14 can be dropped through the central aperture 16 to start the game. The individual players attempt to score by hitting the projectile 14 through a goal 12. The inoperative goals are blocked by a pin 22 to prevent an inadvertent loss of the projectile 14 from the playing surface 6, as can be seen in FIG. 1.

As can be readily appreciated, it is possible to deviate from the above embodiments of the present invention and as will be readily understood by those skilled in the art, the invention is capable of many modifications and improvements within the scope and spirit thereof. Accordingly, it will be understood that the invention is not to be limited by the specific disclosed embodiment but only by the scope and spirit of the appended claims.

What is claimed is:

1. A hockey game apparatus for two or more players comprising:

a game projectile;

at least a pair of striking members for propelling the game projectile;

a totally planar playing surface for supporting the projectile during the game; and a hollow shell housing having a top portion and a side member enclosing the playing surface, the top portion having a first plurality of apertures for permitting ingress and egress of the striking members through a player selected aperture to move the game projectile across the playing surface, the side member having a second plurality of apertures, some of the side member apertures being positioned above the playing surface and permitting ingress and egress of the striking members while others of the side member apertures are immediately adjacent the periphery of the playing surface and form goal positions on the housing for receiving the game projectile to provide a score by a player.

2. The invention of claim 1 wherein the height of the shell housing is less than the length of the striking members for propelling the game projectile.

3. The invention of claim 1 wherein the apertures in the shell housing are arranged to provide an appearance of a cake of Swiss cheese to the housing.

4. The invention of claim 3 wherein the game projectile has indicia indicating the appearance of a mouse.

5. The invention of claim 1 wherein the apertures are dimensioned to prevent the insertion of the player's hand into the housing.

6. The invention of claim 1 wherein the shell housing has a circular disc shape.

7. The invention of claim 1 wherein the striking members have an L-shape.

8. The invention of claim 1 further including a score means for indicating a score tally for each player.

9. The invention of claim 8 wherein the score means includes a plurality of holes and a peg for each player.

10. The invention of claim 1 wherein the shell housing has a cylindrical shape with the first plurality of apertures arranged about the side and top of the shell housing to provide an appearance like a cake of Swiss cheese.

11. The invention of claim 10 wherein the striking members have an L-shape and a height greater than the height of the shell housing.

12. The invention of claim 11 further including score means including a plurality of holes and a peg, the goal apertures further including a hole for receiving a peg to render the goal aperture inoperative for passing a game projectile.

13. A hockey game apparatus for two or more players comprising:

a game projectile;

at least a pair of hockey style type striking members for propelling the game projectile;

a planar playing surface for supporting the projectile during the game; and a hollow opaque shell housing having a configuration resembling a cake of Swiss cheese including a top portion and a side member enclosing the playing surface and limiting player access to the playing surface, the top portion having a first plurality of apertures of sufficient size to permit ingress and egress of the striking members while the side member has a second plurality of apertures, some of the side apertures being adjacent the playing surface to provide goal positions on the shell housing for passing the game projectile to provide a score by a player, other of the side member apertures being above the playing surface and of sufficient size to permit ingress and egress of the striking members, whereby at least two players can respectively insert their hockey style striking members in any of the plurality of top portion and non-goal side member apertures to move the game projectile across the playing surface, each player attempting to propel the game projectile so as to avoid the other player's hockey style type striking member and score a goal through the opposing player's predetermined goal aperture.

* * * * *